United States Patent [19]

Day

[11] 4,424,938

[45] Jan. 10, 1984

[54] WEAR-RESISTANT LINER FOR ROTARY GRINDING MILLS

[75] Inventor: John T. Day, Westminster, Md.

[73] Assignee: Rubber Millers Inc., Baltimore, Md.

[21] Appl. No.: 329,713

[22] Filed: Dec. 11, 1981

[51] Int. Cl.[3] ..... B02C 17/22

[52] U.S. Cl. ..... 241/182; 241/299; 241/DIG. 30

[58] Field of Search ..... 241/181, 182, 183, 299, 241/300, DIG. 30

[56] References Cited

U.S. PATENT DOCUMENTS

| | | | |
|---|---|---|---|
| 1,132,909 | 3/1915 | Brinton . | |
| 1,470,597 | 10/1923 | Denny et al. . | |
| 1,538,620 | 5/1925 | Canda . | |
| 1,601,956 | 10/1926 | Gammeter . | |
| 1,690,493 | 11/1928 | Marcy . | |
| 2,058,257 | 10/1936 | Porteous . | |
| 2,885,156 | 5/1959 | Fitz et al. | 241/182 |
| 3,318,537 | 5/1967 | Wallin et al. . | |

FOREIGN PATENT DOCUMENTS

| | | | |
|---|---|---|---|
| 2010630 | 8/1978 | Fed. Rep. of Germany | 241/182 |
| 391855 | 12/1973 | U.S.S.R. | 241/183 |

*Primary Examiner*—Mark Rosenbaum

*Attorney, Agent, or Firm*—C. Hercus Just

[57] ABSTRACT

The invention comprises resilient lining panels formed preferably from polyurethane of certain specified hardness and provided with leading and trailing sides between which a material-engaging surface is formed which has a smoothly curved wave configuration cresting nearer the trailing than the leading side, the leading side terminating in a relatively thin wedge-shaped flange which is overlaid with a thicker clamping flange on the trailing side, and a metallic clamping member is positioned within the panels, extending between opposite ends thereof, and having flat ribs extending laterally and oppositely from a channel arrangement into at least the overlapping flanges of the trailing side of the panel to effect firm clamping against the flange on the leading side of each panel.

8 Claims, 10 Drawing Figures

Fig. 1
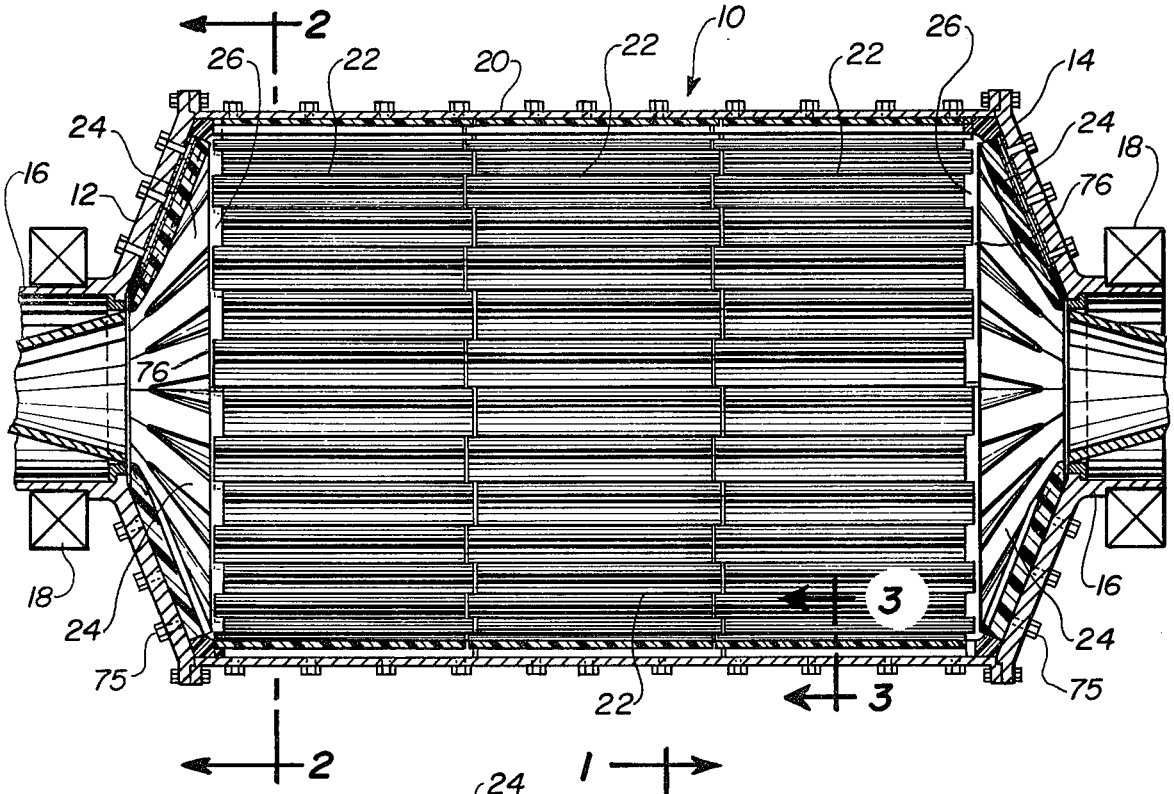
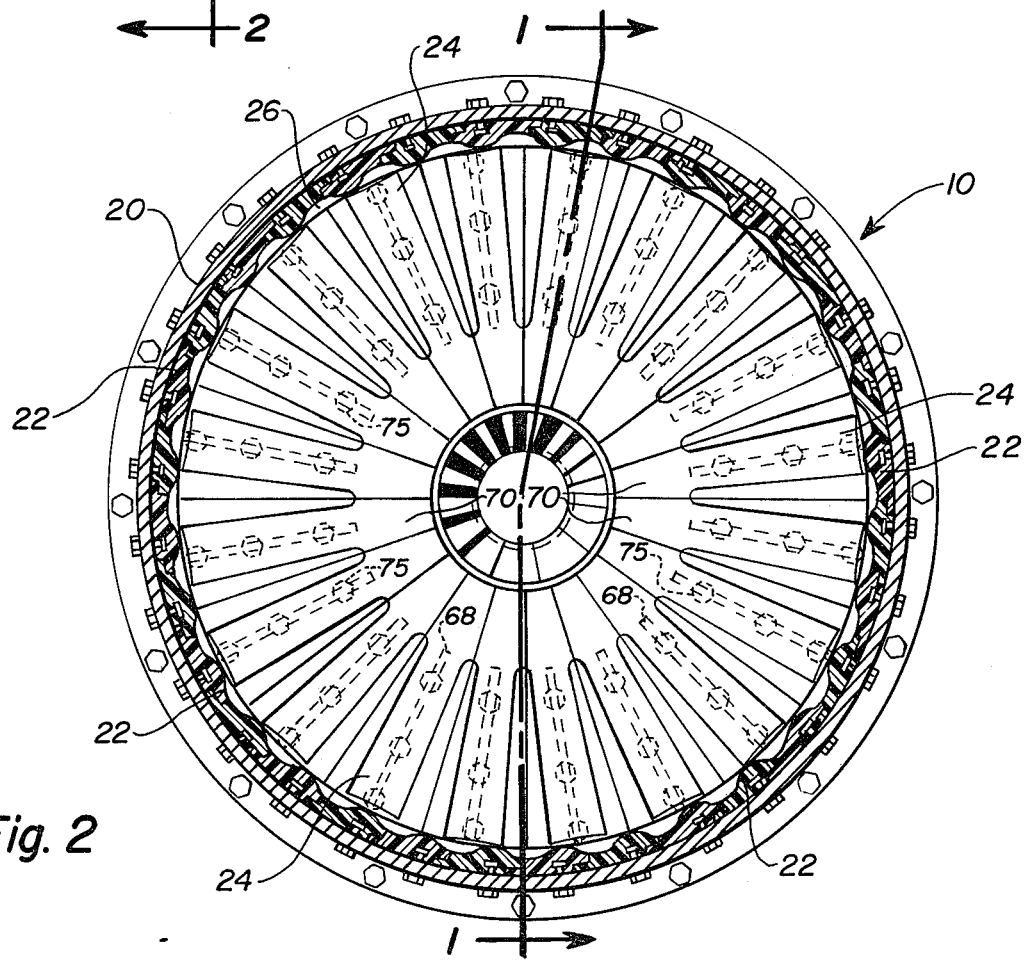
Fig. 2

WEAR-RESISTANT LINER FOR ROTARY GRINDING MILLS

The present invention pertains to an improved liner for rotary grinding mills for purposes of extending the normal life of the grinding mills greatly beyond that which is possible with currently used structures, details of which are set forth below.

BACKGROUND OF THE INVENTION

For many years, a very popular mechanism for reducing lumps or large pieces of various kinds of material to smaller sizes has been either a cylindrical or frusto-conical shell that is circular in cross-section and having opposite ends connected to the shell to form an enclosure for the material to be reduced in size and grinding media, one common form of which has comprised balls formed from different types of material, preferably of a hard nature. The shells comprising said mills are supported at opposite ends for rotation by suitable power means and appropriate inlet and discharge ports are formed in such shells, usually in the opposite ends thereof. Particularly for purposes of preventing the inner surfaces of such shells from being damaged by the rotating material and grinding media, it has been common practice to line the inner surfaces of said shells with wear-resisting devices, usually in the form of arcuate plates or segments extending circumferentially around the inner surfaces of such cylindrical or frusto-conical body and the ends thereof, said plates or segments heretofore having been formed from various kinds of metal alloy selected and designed especially to resist wear during contact thereof with the material being processed and the grinding media which effects such reduction in size. Some typical examples of such structures comprise the subject matter of:

U.S. Pat. No. 1,132,909—Brinton, dated Mar. 23, 1915

U.S. Pat. No. 1,538,620—Canda, dated May 19, 1925

U.S. Pat. No. 1,690,493—Marcy, dated Nov. 6, 1928

As early as the 1920's, there developed a type of lining formed of rubber compounds formed into suitable configurations, such as longitudinally extending ridges circumferentially spaced from each other and secured to the inner surface of the shell of the mill by appropriate bolts having head portions secured within said rubber lining segments. Possibly either because of the type of rubber then available, or otherwise, such liners did not appear to suitably increase the life of the liner beyond that which was capable of conventional metal liner segments, and as far as is known, the use of such rubber lining devices was not popularly followed. Typical examples of rubber-type linings for rotatable mills are illustrated in the following prior U.S. Patents:

U.S. Pat. No. 1,470,597—Denny et al., dated Oct. 16, 1923

U.S. Pat. No. 1,601,956—Gammeter, dated Oct. 5, 1926

U.S. Pat. No. 2,058,257—Porteous, dated Oct. 20, 1936

In much more recent times, further refinements in rubber liners have been made which, for example, comprise the subject matter of U.S. Pat. No. 3,318,537 to Wallin et al., dated May 9, 1967, the details of such structure being directed primarily to the joint-forming means between successive panel-like lining elements, as well as the formation of longitudinal ribs thereon of a somewhat rectangular nature in plan view.

In accordance with the present invention, it now has been found that vastly improved wear-resistance can be achieved by the use of presently available synthetic resin or plastic materials from which to form preferred configurations of especially the material-engageable surfaces of such panels, details of which are set forth below:

SUMMARY OF THE INVENTION

It is among the principal objects of the present invention to form a composite liner for a drum of a rotary grinding mill in the nature of a series of similar elongated elastomeric liner panels adapted to extend axially within a drum having a circular cross-section and rotatable in a predetermined rotary direction, one preferred type of elastomeric material comprising polyurethane, especially polyurethane which is compounded to provide a hardness rating, for example, between 60 Shore A and 80 Shore D.

Another object of the invention is to provide such panels with leading and trailing sides which are substantially the same thickness with respect to the drum-engageable surfaces thereof and the opposite material-engaging surfaces of the panels having a smoothly curved wave configuration extending upwardly in a gradual curve from the leading side of the panel with respect to the direction of rotation of the drum and cresting nearer the trailing side than the leading side and then descending toward the trailing side in a shorter curve, whereby the greater mass of resilient lining material is adjacent the trailing side of the panels for purposes of minimizing the wear at the joint between adjacent panels and providing less turbulent influence on the leading side of the wave configuration.

A further object of the invention is to form the joints between the sides of adjacent panels in a preferred shape in which the leading side terminates in a stepped-down thin flange adapted to extend into a complementary recess in the drum-engageable surface of the trailing side of a succeeding panel, whereby said recess in the trailing side of the succeeding panel also defines a flange which overlies the stepped-down thin flange in the leading side of said panel.

Ancillary to the foregoing object is further to dispose the abutting surfaces of the overlying flanges respectively on the leading and trailing sides of the panels within a plane extending at an acute angle to the drum-engageable surface of the panels, said angle extending upwardly and away from said drum-engageable surface toward the terminal end of the leading side of the panel, thereby providing a somewhat dovetailed, wedging action to insure clamping of the leading side of the panels firmly against the drum surface.

A still further object of the invention is to provide in the drum-engageable surface of each panel a longitudinally extending recess provided with a central axis disposed substantially beneath the crest of the wave surface of the panel and in which an elongated clamping member is positioned and provided with a channel opening toward the drum-engageable surface of the panel to receive heads of clamping bolts to secure the panel to the drum, said clamping member having laterally-extending ribs directed in opposite directions respectively toward said leading and trailing sides of the panels, the rib nearest the trailing side of said panels extending a suitable distance into the overlying flange on the trailing side of the panels to reinforce the same and insure firm clamping thereof against the stepped-down flange on the leading side of a succeeding panel.

Still another object of the invention is to space the rib which extends toward the leading side of the panel closer to the drum-engageable surface of the panel than the opposite rib but, nevertheless, spaced from the drum-engageable surface of the panel sufficiently to dispose a relatively thin portion of the panel for clamping the same between said rib and the inner surface of the drum.

One further object of the invention is to provide the leading side of each panel on the drum-engageable surface thereof with a longidutinally-extending bedding bead parallel to said leading side and engageable with the inner surface of a mill drum to prevent ingress of extraneous material between said panels and the drum wall, which material could be capable of causing racing.

Another object of the invention is to form some of said panels with the opposite sides thereof in divergent relationship to render the panels segmental and thereby adapt the same for radial disposition in a drum for attachment to the ends of the drum and the crest of the wave configuration of said panels being substantially midway between the opposite sides thereof.

A further object of the invention is to form the panels with a radius of curvature on the drum-engageable surface thereof which is greater than that of the curvature of the drum, whereby when the panels are installed against and conformed to the inner surface of the drum, the material life and engaging surface portions of the panels are compressed a predetermined amount which renders said portions relatively relaxed and more resistent to abrasion than when in the initial shape thereof.

An additional object of the invention is to form the crest of the wave on said material-engaging surfaces of the panel with a thickness in excess of twice the thickness of the sides of the panels at the joints of adjacent connected panels.

Ancillary to the foregoing object, it is another object to form the stepped-down thin flange of the leading side of the panels so as to be less than half the thickness of the side of the panel from which it extends and the portion of the trailing side of the panel which overlies said flange is over half the thickness of the portion of the trailing side of the panel to which it is connected.

Still another object of the invention is to arrange a plurality of said panels of similar length against the inner surface of a drum in such manner that the similar ends of alternate panels are in staggered relationship relative to the ends of the drum to prevent the formation of a circular joint line of the panels in the drum when pluralities of said panels are mounted in end-to-end relationship throughout the length of the drum, said invention further including a filler ring having one elongated surface complementary in shape to the staggered arrangement of the ends of the panels nearest the ends of the drum.

Details of the foregoing objects and of the invention are set forth hereinbelow and are illustrated in the drawings comprising a part thereof.

BRIEF DESCRIPTION OF THE DRAWINGS

FIG. 1 is a vertical, longitudinal sectional view of a rotary mill embodying the principles of the present invention, as seen on the line 1—1 of FIG. 2.

FIG. 2 is a transverse sectional view of the mill shown in FIG. 1, as seen on the line 2—2 thereof.

DETAILED DESCRIPTION OF THE PREFERRED EMBODIMENTS

Figure 3:
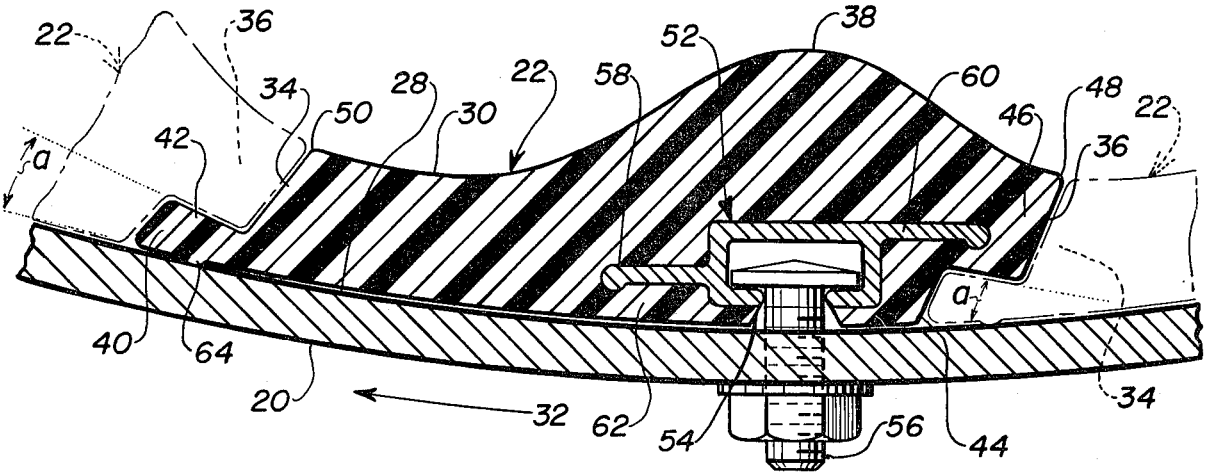
FIG. 3 is a fragmentary transverse sectional view of a portion of the drum of a mill and one of the liner panels shown clamped to said drum section with the opposite ends of said panel being shown in operative, clamped relationship with respect to fragmentarily illustrated portions of preceding and following sections illustrated in phantom.

In FIGS. 1 and 2, there is illustrated an exemplary showing of a rotary grinding mill 10, which is substantially cylindrical in shape, the opposite ends 12 and 14 being somewhat conical, and sleeve-like projections 16, which extend from the ends 12 and 14 are supported in appropriate bearings 18. In many types of mills one end constitutes the inlet and the opposite end, the discharge end. For purposes of the present invention, specific designation of such feed and discharge means is unnecessary. It also is to be understood that the present invention primarily pertains to resilient lining means for the interior of the metal drum 20 of the mill 10 and therefore, the cylindrical shape of the drum 20 is merely exemplary, rather than restrictive.

Figure 9:
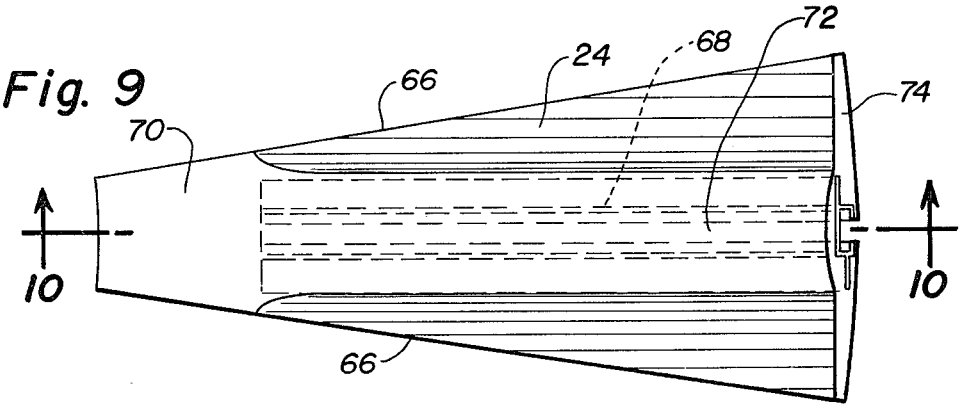
FIG. 9 is a plan view of a segmental panel adapted to be clamped to the end walls of rotatable grinding mill in accordance with the principles of the invention.

In accordance with the present invention, the lining for the interior of the drum 20 preferably is in the form of a plurality of similar panels 22, one of which is shown in full lines and in cross-section in FIG. 3. Primarily for purposes of manufacture and assembly, it is preferred that the panels 22 be of limited length, whereby as illustrated in exemplary manner in FIG. 1, a plurality of said panels are arranged in end-to-end relationship and alternate panels are staggered a short distance longitudinally in order that there is not a continuous circular meeting line between adjacent sets of the panels for purposes of minimizing wear. The panels 22 are secured to the shell by bolt means, details of which are described hereinafter. Also, in accordance with the invention, the ends 12 and 14 are covered by wear-resistant, protective panels 24, which are segmentally shaped as best shown in FIGS. 2 and 9. As viewed in FIG. 2, the outer extremities of the segmental panels 24 are in close proximity to the nearest ends of the longitudinally-extending lining panels 22 and especially in order to provide a lining seal between the outer ends of the segmental panels 24 and the aforementioned ends of the longitudinal panels 22, which are in staggered relationship, as shown in FIG. 1, the present invention contemplates the employment of a filler ring composed of similar segments 26, details of one such segment being shown in FIGS. 6 and 7, and otherwise, the filler rings 26 are shown in FIGS. 1 and 2, in smaller scale than employed in FIGS. 6 and 7. Hence, it will be seen that the entire interior of the drum 20 of the rotary grinding mill 10 is protected from abrasion existing against the metal surfaces of the shell and its ends which are formed of suitable steel or the like.

In the development of the present invention, it has been found that, rather than employing rubber, it is much more advantageous for purposes of minimizing abrasion and wear of the lining elements to use polyurethane or its equivalent, which is compounded suitably to have a hardness of between 60–90 Shore A and 80 Shore D, which has adequate resilience to facilitate the grinding operation of conventional grinding balls and the like within the mill, as well as protect the inner surfaces of the drum and ends of the mill from contact with the grinding elements and media being acted upon. While the range of hardness suitable for the present invention is set forth above, it has been found that an optimum hardness is appromimately 85 Shore A.

The cross-sectional shape of the lining panels 22 has been derived after considerable experimentation for purposes of minimizing wear, as well as facilitating the grinding operation. By referring to FIG. 3, it will be seen that the drum-engageable surface 28 of the panel 22 closely conforms to the inner surface of the drum 20 and firmly abuts the same by clamping means described hereinbelow. Initially, it is preferred that the drum-engageable surface 28 be substantially flat or at least have a radius of curvature much greater than that of the drum 20, whereby when the panel is closely clamped against the inner surface of the drum 20, the upper portion of the panel 22 is placed in compression which actually relaxes the material and thereby maximizes the resistance to wear in view of the fact that polyurethane, when under compression, definitely appears to have superior resistance to wear, as compared with polyurethane when under tension, and therefore, the material-engaging surface 30 of panel 22 is the most relaxed portion of the panel.

It also will be seen that, as shown by the direction arrow 32, the left-hand end of the panel as shown in FIG. 3, comprises the leading side 34 of the panel, while opposite side 36 is the trailing side. To illustrate the manner in which successive panels engage each other in accordance with the invention, FIG. 3 also shows fragmentarily, in phantom, adjacent ends of the two additional panels which respectively engage the leading and trailing ends of the central panel 22. From FIG. 3, it also will be seen that the material-engaging surface 30 of the panel 22 is in the form of a non-symmetrical wave shape, having a crest 38 and concave leading and trailing surfaces extending in opposite directions therefrom, and a greater amount of wear-resistant material is on the leading side of the wave and the longitudinal joint between the segments is in the so-called shadow of the wave, i.e., the back of the wave or trailing side, which accomplishes two purposes. One is that there is less wear at the joint and there is less turbulent influence on the leading side of the following wave.

A very important feature of the present invention, in addition to the shape of the material-engaging surface 30, lies in the joints between adjacent sides of successive panels, which are best illustrated in FIG. 3. It will be seen that the respective joints have an overlapping arrangement by virtue of the leading side 34 terminating in a stepped-down thin flange 40, which is formed by a notch 42 in the leading side 34, extending downward from the material-engaging surface 30 thereof. The trailing side 36 also has a recess 44 extending thereinto upwardly from the drum-engageable surface 28 of the panel, said recess 44 being very closely complementary to the stepped-down thin flange 40 and it will be seen that the co-engaging surfaces of the notch 42 and the flange 40 are within planes disposed at a sharp acute angle "a," shown in FIG. 3, which produces somewhat of a dovetailed or wedging action which tends to maintain the joints in a tight condition and also resists any circumferential movement between adjacent panels at the joint areas. Therefore, it will be seen that the opposite sides of the panel 22, when connected to additional leading and trailing panels respectively have an underlying flange at the leading side and an overlying flange 46 at the trailing side, which is received within the notch 42 in the leading side of the next following panel 22. Clamping means to effect desired sealing and clamping is described below.

The above-described joint and the elements that form the same are so shaped that, starting with the leading side 34 of panel 22, it will be seen that the material-engaging surface comprises a smoothly curved wave configuration which extends upwardly in a gradual curve from said leading side and crests nearer the trailing side than the leading side, then descending toward the trailing side in a shorter curve than the upwardly extending curve. Further, from FIG. 3, it clearly will be seen that the uppermost terminal edge 48 of trailing side 36 is spaced from what would be a continuation of the drum-engageable surface a distance substantially equal to the distance of the forwardmost terminal edge of the leading side 34 from the drum-engageable surface 28, directly below the same, thus providing a smooth continuity of curvature between the trailing and leading material-engaging surfaces of successive panels at the joints thereof. Further, especially for purposes of providing ample material at the crest 38, the distance of the crest 38 from the drum-engageable surface of the panel preferably is at least a little more than twice the distances of the uppermost and forwardmost terminal edges 48 and 50 of the trailing and leading sides of the panel from the drum-engageable surface thereof.

Each panel 22, preferably directly below the crest 38, is provided with clamping means in the form of an elongated clamping member 52, which, as seen in FIG. 3, in cross-section, is substantially rectangular and is provided in the lower wall thereof with a slot 54, thereby forming a channel opening toward the drum-engageable surface of the panel to receive heads of a series of clamping bolts 56, the slot 54 extending preferably for the full length of each of the members 52, which, in turn, extend preferably for the full length of each of the panels 22. Also, and very importantly, clamping member 52 has a pair of laterally extending ribs 58 and 60 respectively directed toward the said leading and trailing sides of the panels, said ribs preferably being parallel to each other, but the rib 60 is spaced from the drum-engageable surface of the panel a greater distance than the rib 58. Said ribs are coextensive in length with the clamping member 52 and the outer edges of both of the ribs preferably are slightly enlarged and rounded for purposes of forming a non-abraiding connection with the elastomeric material which surrounds the clamping member 52.

The purpose of the different positioning of the ribs 58 and 60 upon opposite sides of the clamping member 52 is for purposes of extending the rib 60 appreciably into the overlying flange 46 at the trailing side of the panel 22 and thereby, insuring firm coengagement between the abutting surfaces of the flange 40 and recess 44 in the trailing side of the panels, thereby enhancing the locking and sealing effect produced by the wedging configuration of the abutting portions of successive panels. In regard to rib 58, it is disposed closer to the drum-engageable surface 28 of the panels than the rib 60 for purposes of defining therebeneath a relatively thin flange 62 of the elastomeric material, thereby clamping particularly the midportion of the panels against the inner surface of the drum 20, and this is important especially in the event there is any attempt at migration between the coengaging sides of the panels at the joints thereof. The lateral dimension of the ribs 58 and 60 is selected to effect the desired clamping functions described above.

As desired, the clamping member 52 may either be molded in situ within the elastomeric material comprising the panel 22 or a longitudinally extending channel, complementary in shape to the cross-section of the clamping member, may be formed initially in the panel for purposes of slidably receiving the clamping member 52 so as to extend between opposite ends of the panel. Also, in the preferred construction, a series of the bolts 56 will be mounted at spaced intervals with the heads thereof engaging the flanges on opposite sides of the slot 54, the stems of the bolts extending through a suitable row of holes formed in the metal drum 20 to which washers, nuts, etc. are connected in normal manner, said nuts preferably being drawn tightly to insure the clamping of the above-described coengageable surfaces in the opposite sides 34 and 36, as well as that of the relatively thin flange 62 with respect to the inner surface of the drum 20.

Figure 5:
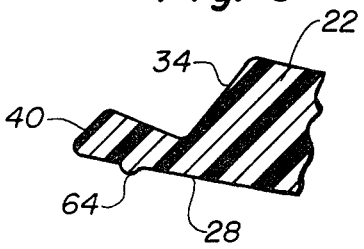
FIG. 5 is a fragmentary vertical sectional view, showing the left-hand end of the unitary panel shown in FIG. 3, and illustrating on the drum-engageable surface thereof a longitudinally extending bedding bead adapted to engage the inner surface of a drum.

Another feature of the invention illustrated in FIG. 5 in fragmentary manner comprises the provision of an elongated rib or bead 64, which comprises a bedding bead and, being of a resilient nature, closely conforms to the inner surface of the drum 20 which, under certain circumstances, may be somewhat irregular at least to a small extent, and by clamping said bedding bead 64 against such surface and having it firmly conforming thereto, said bead acts as a dam to prevent the ingress of extraneous material, either liquid or solid, which, if the same migrates between the drum-engageable surface 28 of the panel and the inner surface of the drum, will cause what is known in the industry as racing, which tends to have a deleterious effect upon the inner surface of the drum 20, either through abrasion or chemical action.

Figure 10:
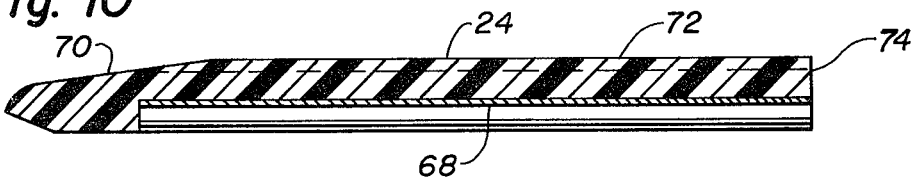
FIG. 10 is a longitudinal sectional view of the segmental panel of FIG. 9, as seen on the line 10—10 of FIG. 9.

As described above, with respect to FIGS. 1 and 2, the ends 12 and 14 of the drum 20, whether relatively flat or frustoconical, must also be protected against abrasion and this is accomplished by providing a plurality of segmental or wedge shaped lining panels 24, as illustrated especially in FIG. 2 and also in detail in FIGS. 9 and 10. Said panels have diverging sides 66 and also are provided with a clamping member 68, which preferably is similar in shape to the clamping member 52, shown in the preceding figures but preferably the clamping member does not extend to the innermost end 70 of the lining panels 24. Further, the curved, material-engaging surface has a crest 72, which is substantially midway between the diverging sides 66, as shown in FIGS. 9 and 10. The clamping member 68 also receives the heads of a plurality of longitudinally-spaced bolts 75, as shown in FIGS. 1 and 2.

Figure 8:
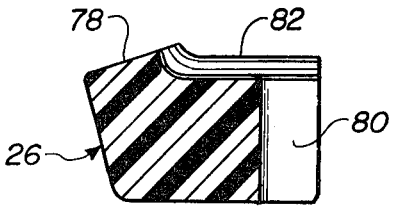
FIG. 8 is a transverse sectional view of the end ring shown in FIG. 6, as seen on the line 8—8 thereof.
Figure 6:
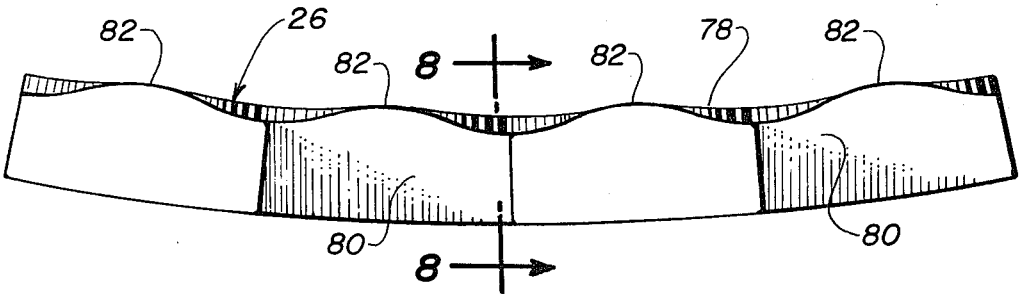
FIG. 6 is an end view of a segment of a filler ring adapted to be disposed between the staggered ends of the longitudinally extending panels, as shown in FIG. 1, and the outer ends of segmental panels clamped to the opposite ends of the mill as shown in FIG. 1.
Figure 7:
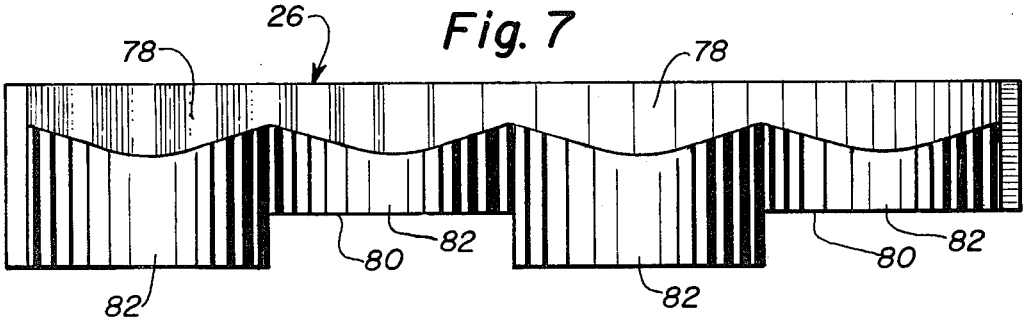
FIG. 7 is a top plan view of the end ring segment, shown in FIG. 6.

The outermost ends 74 of the segmentally-shaped lining panels 24 are disposed within a plane 76 at opposite ends of the drum 20, whereby spaces occur between said plane and the ends of the alternately offset ends of the panels 22. These spaces also expose part of the inner surfaces of the drum 20, and therefore, in accordance with the invention, said spaces are covered by means of a segmentally-arranged filler ring 26, identified in FIG. 1 and individual segments 78 thereof being shown respectively in end and plan views in FIGS. 6 and 7, said segments being provided with notches 80 to receive the ends of the alternate panels 22, which project beyond the inbetween panels. In FIG. 8, a cross-sectional view of the segments 78 is shown and, for purposes of said segments conforming to the crests of the panels 22, corresponding similar crests 82 are formed upon the segments as illustrated in FIGS. 6–8. Due to the curved shape of the segments 26 of the filler ring, when the same are disposed in circular configuration, they preferably are somewhat wedged between the adjacent ends of the segmental lining panels 24 and the staggered ends of the panels 22, so that with the opposite ends of the segments in abutting relationship with corresponding ends of adjacent panels, together with the engagement of these rings with the grinding media and the like, no further clamping action is necessary.

From the foregoing, it will be seen that the present invention provides substantial improvements over the known prior art, the most essential items of which are described hereinabove, both from the standpoint of efficiency of grinding operations, as well as very substantial life being afforded the various panels of the liner due to the selection of material, such as polyurethane or its equivalent, with respect to resilience and hardness within the ranges set forth above, particularly in the smoothly curved contour of the material-engaging surfaces 30 of the panels 22, which have crests 38 closer to the trailing side than the leading side, and said respective sides also being provided with highly practical and effective coengagement for sealing and positioning purposes in the form of underlying and overlying flanges or extensions formed, for example, by notches 42 in the leading side of the panel and recesses 44 in the trailing sides thereof, as well as the thickness of the overlying flange 46 in the trailing side of the panel being substantially thicker than the much thinner stepped-down thin flange 40 in the leading side of the panel, and the wedge-shaped coengaging arrangement of the abutting surfaces of adjacent leading and trailing sides of successive panels further enhancing the maintenance of tight joints between adjacent panels.

Figure 4:
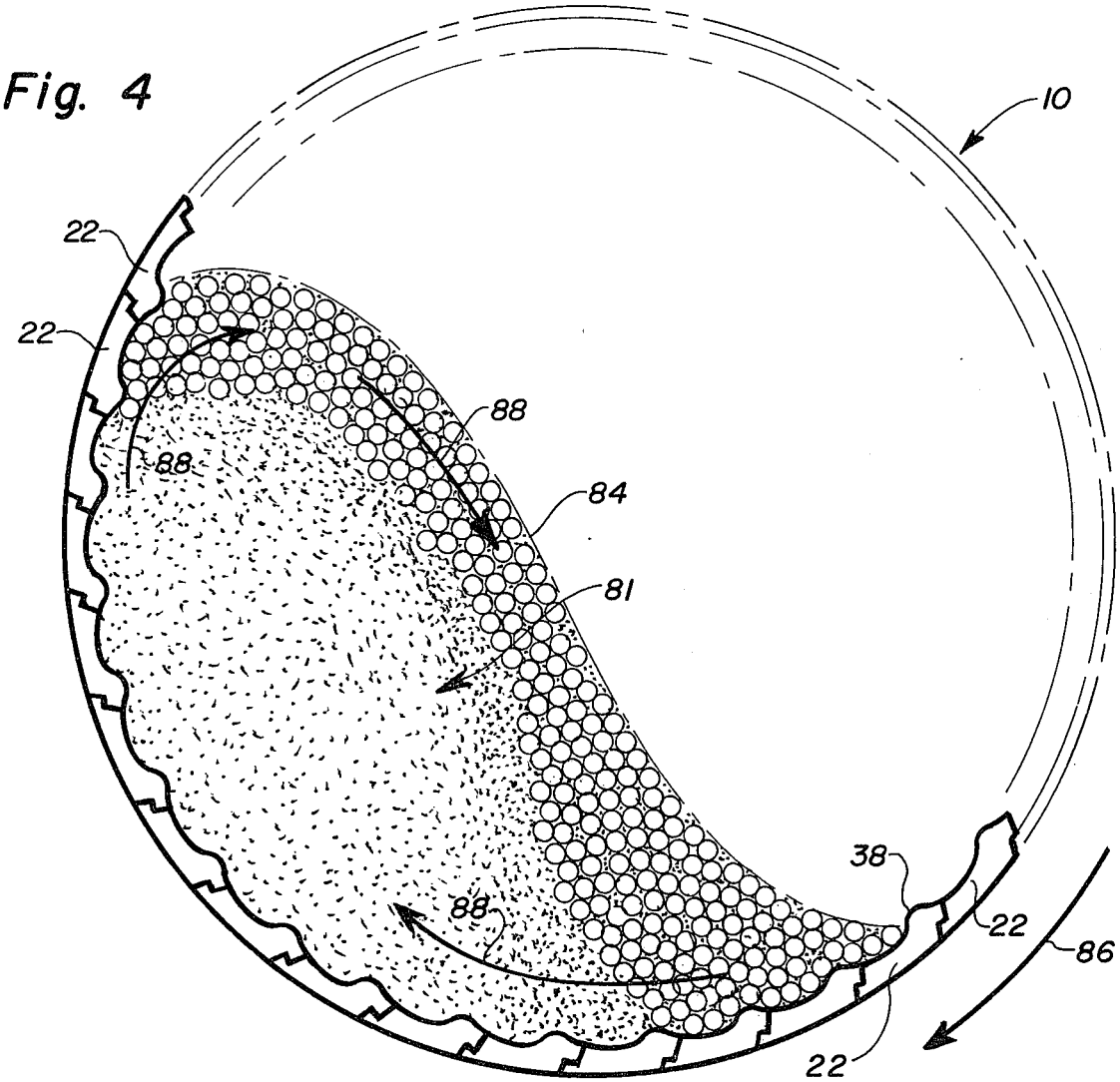
FIG. 4 is a transverse sectional view of a drum, similar to that shown in FIG. 2, but illustrating in diagrammatic manner an exemplary disposition of grinding media and material being ground thereby during the rotation of the mill in the direction of the arrow shown adjacent said figure.

By referring to FIG. 4, which is a diagrammatic presentation of the manner in which mixed grinding media, such as balls and the material being ground thereby, is indicated in a mass 81, the upper surface of which is somewhat as indicated by the diagrammatic line 84. As the tumbling material moves downward in direction of the line 84, it will be seen at the lower end of the line 84 that the material is engaging the leading side of the smoothly-rounded crest 38 of one of the panels 22, this area of the panel being the thickest for purposes of absorbing shock and also, under certain circumstances, providing somewhat limited projection of the elements which engage the same in a falling manner, so as to cause the elements to fall upon other elements so as to enhance the crushing operation of the mill, when rotating in the direction of the arrow 86, and producing somewhat turbulent movement of the mass 81 of the material, which travels somewhat in the direction of the arrows 88, shown in FIG. 4.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A composite liner for the drum of a rotary grinding mill comprising a series of similar elongated elastomeric liner panels adapted to extend axially of a drum having a circular cross-section and rotatable in a predetermined rotary direction, whereby said panels have leading and trailing sides relative to said direction of rotation and also a drum-engageable surface, said leading and trailing sides being of substantially the same thickness with respect to the drum-engageable surface but the leading side terminating in a stepped-down thin flange adapted to extend into a complementary recess in the drum-engageable surface of the trailing side of a succeeding panel when connected to said drum and thereby present substantially smooth adjacent material-engageable surfaces at the joints of said connected panels, the opposite material-engaging surface of said panels having a smoothly curved wave configuration extending upwardly in a gradual concave curve from the leading side of the panel and cresting nearer the trailing side than the leading side and then descending toward the trailing side in a shorter concave curve than the side of the wave ascending from the leading side and blending with the gradual concave curve of the leading side of the next succeeding panel, the drum-engageable surface of each panel having a longitudinally extending recess provided with a central axis disposed substantially beneath the crest of the wave surface, and an elongated clamping member positioned in said recess and provided with a channel opening toward the drum-engageable surface of said panel to receive heads of clamping bolts to secure the panels to the drum, said clamping member having laterally extending ribs directed in opposite directions respectively toward said leading and trailing sides of the panels, said ribs being substantially parallel to said drum-engageable surface of said panels and offset different distances therefrom, the rib nearest the trailing side of the panel being spaced farther from said drum-engageable surface than the other rib and extending into the portion of the trailing side of said panel which overlies said recess in said trailing side to firmly clamp said stepped-down thin flange of the leading side of the succeeding panel against the inner surface of said drum.

2. The composite liner according to claim 1 in which the co-engaging surfaces of the stepped-down thin flange of the leading side of the panel and the portion of the trailing side of a succeeding panel which overlies the same lie in a common plane extending at an acute angle to the drum-engageable surface of the panel and extending upwardly and away from said surface toward the terminal end of said leading side of one panel, thereby providing a wedging action insuring clamping of said leading sides against a drum surface.

3. The composite liner according to claim 1 in which the terminal edges of said ribs are slightly thickened and rounded to provide a non-abrading engagement with the elastomeric material.

4. The composite liner according to claim 1 in which the leading side of each panel is provided on the drum-engageable surface with a longitudinally extending bedding bead parallel to said leading side and coextensive in length with the panel and engageable with the inner surface of a mill drum to prevent ingress of extraneous material between said panels and drum wall such as being capable of causing racing.

5. The composite liner according to claim 1 in which the elastomeric material comprises polyurethane having a hardness rating between 60 Shore A and 80 Shore D.

6. The composite liner according to claim 1 in which said panels prior to installation in a drum have a radius of curvature on the drum-engageable surface thereof greater than that of the curvature of the drum, whereby when said panels are installed against and conformed to the inner surfaces of the drum and material-engaging surface portions of at least the leading and crest areas of the panels are compressed a predetermined amount which renders said portions relatively relaxed and more resistant to abrasion than when in the initial shape thereof.

7. The composite liner according to claim 1 in which the stepped-down thin flange of the leading side of the panels is less than half the thickness of the side of the panel from which it extends and the portion of the trailing side of the panel which overlies said flange is over half the thickness of the portion of the trailing side of the panel to which it is connected to provide clamping strength in the trailing side.

8. The composite liner according to claim 1 in which there is a relatively thin portion of the panel between the surface of the rib nearest the drum-engageable surface of the panels and the surfaces abutted by said thin portions when clamped to the inner surface of a drum, whereby the elastomeric material is firmly attached to the drum surface in the event of failure of any bonding between said clamping member and the elastomeric material.

* * * * *